US009626886B2

(12) United States Patent
Francavilla et al.

(10) Patent No.: US 9,626,886 B2
(45) Date of Patent: Apr. 18, 2017

(54) DOOR HANDLE DISPLAY MEMBERS

(71) Applicant: Display Technologies, LLC, Lake Success, NY (US)

(72) Inventors: Steven Francavilla, Huntington, NY (US); Jon A. Noce, Haverhill, MA (US); Mark Charles Biddison, Long Beach, NY (US); Marty Illers, Yonkers, NY (US); Andrew Howard, Mamaroneck, NY (US)

(73) Assignee: Display Technologies, LLC, Lake Success, NY (US)

( * ) Notice: Subject to any disclaimer, the term of this patent is extended or adjusted under 35 U.S.C. 154(b) by 0 days.

(21) Appl. No.: 14/996,308

(22) Filed: Jan. 15, 2016

(65) Prior Publication Data

US 2016/0210889 A1 Jul. 21, 2016

Related U.S. Application Data

(60) Provisional application No. 62/105,391, filed on Jan. 20, 2015.

(51) Int. Cl.

| | |
|---|---|
| ***G09F 3/00*** | (2006.01) |
| ***G09F 23/00*** | (2006.01) |
| ***G09F 7/18*** | (2006.01) |

(52) U.S. Cl.

CPC ..... *G09F 23/00* (2013.01); *G09F 7/18* (2013.01)

(58) Field of Classification Search

CPC ..... A45C 13/42; B26B 1/10; E05B 1/0084; G09F 3/18; G09F 23/00

See application file for complete search history.

(56) References Cited

U.S. PATENT DOCUMENTS

| | | | | | |
|---|---|---|---|---|---|
| 1,430,207 | A * | 9/1922 | Woodhouse | B64D 43/00 | 108/43 |
| 2,768,457 | A * | 10/1956 | Biek | G09F 3/185 | 40/660 |
| 4,951,596 | A * | 8/1990 | Wallace, Jr. | G09F 3/16 | 116/308 |
| 5,138,784 | A * | 8/1992 | Niwa | G09F 3/04 | 40/316 |
| 5,275,282 | A * | 1/1994 | Ross | G09F 3/16 | 206/389 |
| 5,810,372 | A * | 9/1998 | Arendt | B62B 3/1408 | 16/422 |
| 5,871,269 | A * | 2/1999 | Chien | A41D 13/01 | 362/253 |
| 6,651,362 | B2 * | 11/2003 | Caveney | G09F 3/02 | 40/316 |

(Continued)

OTHER PUBLICATIONS

International Search Report and Written Opinion dated Mar. 25, 2016 in corresponding PCT Application No. PCT/US2016/013515.

*Primary Examiner* — Cassandra Davis

(74) *Attorney, Agent, or Firm* — Carter, DeLuca, Farrell & Schmidt, LLP

(57) ABSTRACT

A door handle display member is disclosed. The door handle display member includes an inner portion and a housing. The inner portion is configured to releasably engage a door handle, such that the inner portion at least partially surrounds the door handle. The housing is configured to engage the inner portion, such that the housing at least partially surrounds the inner portion. The housing is configured to engage a graphic panel.

9 Claims, 7 Drawing Sheets

(56) References Cited

U.S. PATENT DOCUMENTS

| | | | | |
|---|---|---|---|---|
| 6,948,272 | B1 | 9/2005 | Olivier et al. | |
| 7,784,208 | B2 | 8/2010 | Thompson | |
| 2002/0050085 | A1* | 5/2002 | Durham | B62B 3/1408 40/661.12 |
| 2003/0136038 | A1* | 7/2003 | Durham | G09F 3/14 40/593 |
| 2005/0144818 | A1* | 7/2005 | Zilberman | A47G 19/2227 40/306 |
| 2014/0001130 | A1 | 1/2014 | English | |

* cited by examiner

DOOR HANDLE DISPLAY MEMBERS

CROSS-REFERENCE TO RELATED APPLICATION

The present application claims the benefit of and priority to U.S. Provisional Patent Application Ser. No. 62/105,391 filed on Jan. 20, 2015, the entire contents of which being herein incorporated by reference in its entirety.

BACKGROUND

The present disclosure relates to display members that are configured to be engaged with a door handle. More particularly, the present disclosure relates to door handle display members that are engageable with a handle of a door (e.g., a refrigerator door) in a retail environment, for example, and which is configured to display product information.

SUMMARY

The present disclosure relates to a door handle display member. The door handle display member includes an inner portion and a housing. The inner portion is configured to releasably engage a door handle, such that the inner portion at least partially surrounds the door handle. The housing is configured to engage the inner portion, such that the housing at least partially surrounds the inner portion. The housing includes a slot configured to slidingly engage a graphic panel.

In disclosed embodiments, the door handle display member also includes a graphic panel configured to slidingly engage the slot of the housing.

In disclosed embodiments, the inner portion is made out of foam.

In disclosed embodiments, the inner portion includes a C-shaped cross-section.

BRIEF DESCRIPTION OF DRAWINGS

Embodiments of the present disclosure are described hereinbelow with reference to the drawings wherein.

DETAILED DESCRIPTION

Embodiments of the presently disclosed door handle display member are described in detail with reference to the drawings wherein like numerals designate identical or corresponding elements in each of the several views. In the descriptions that follow, the term "proximal," as is traditional, will refer to the portions of the door handle display member that are closer to the user (e.g., consumer), while the term "distal" will refer to the portions that are farther from the user.

With reference to the accompanying figures, a first embodiment of a door handle display member 10 is illustrated in FIGS. 1-6. Door handle display member 10 includes an inner portion 100, a housing 200, and an information display portion or graphic panel 300.

Figure 1:
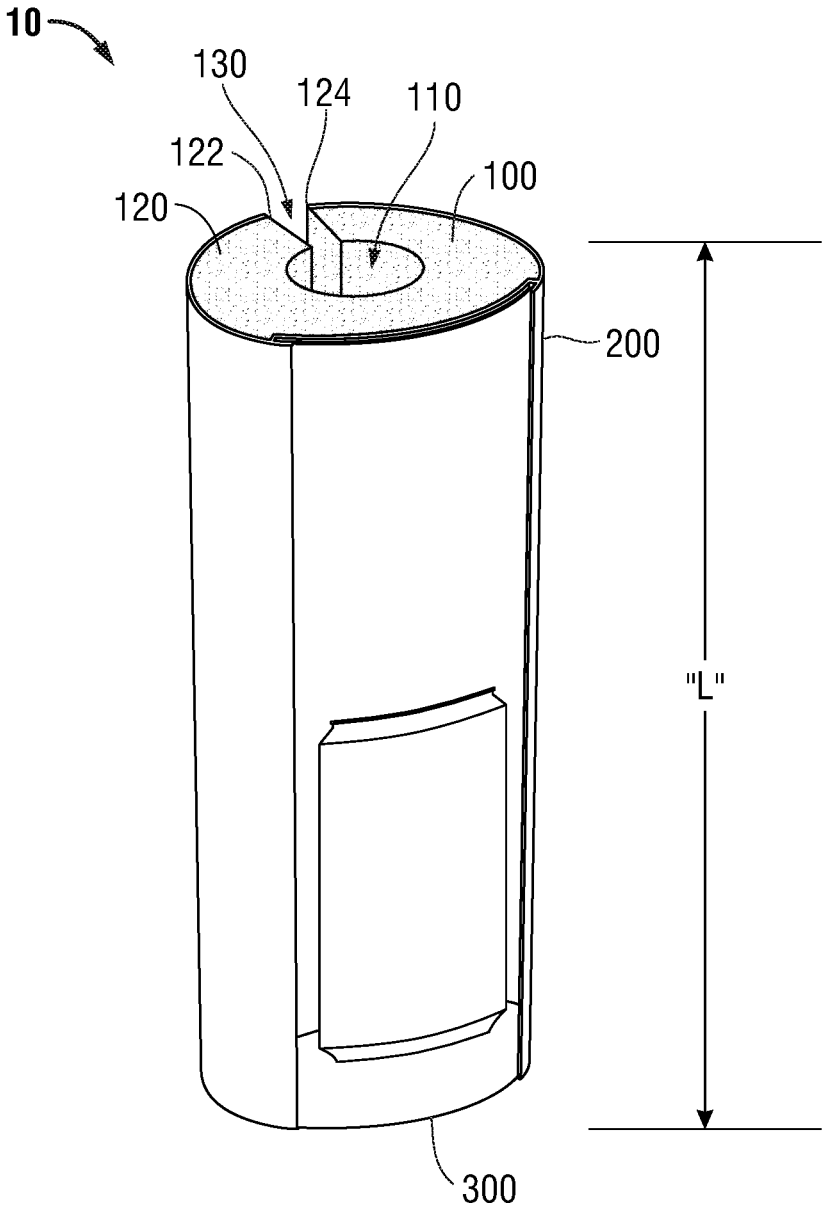
FIG. 1 is a perspective view of a door handle display member of the present disclosure including a foam portion, a housing, and a graphic panel.
Figure 2:
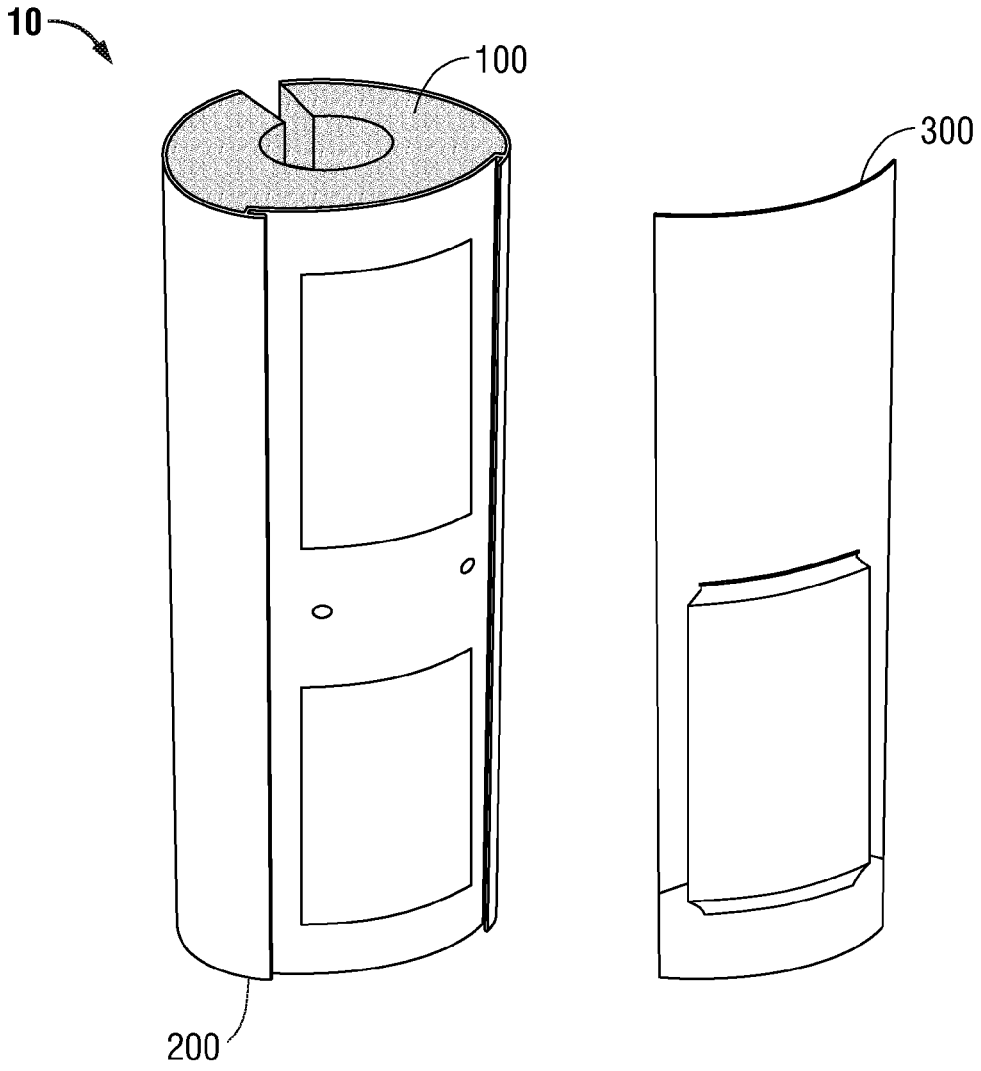
FIG. 2 is a perspective view the door handle display member of FIG. 1 illustrating the graphic panel separated from the housing.
Figure 3:
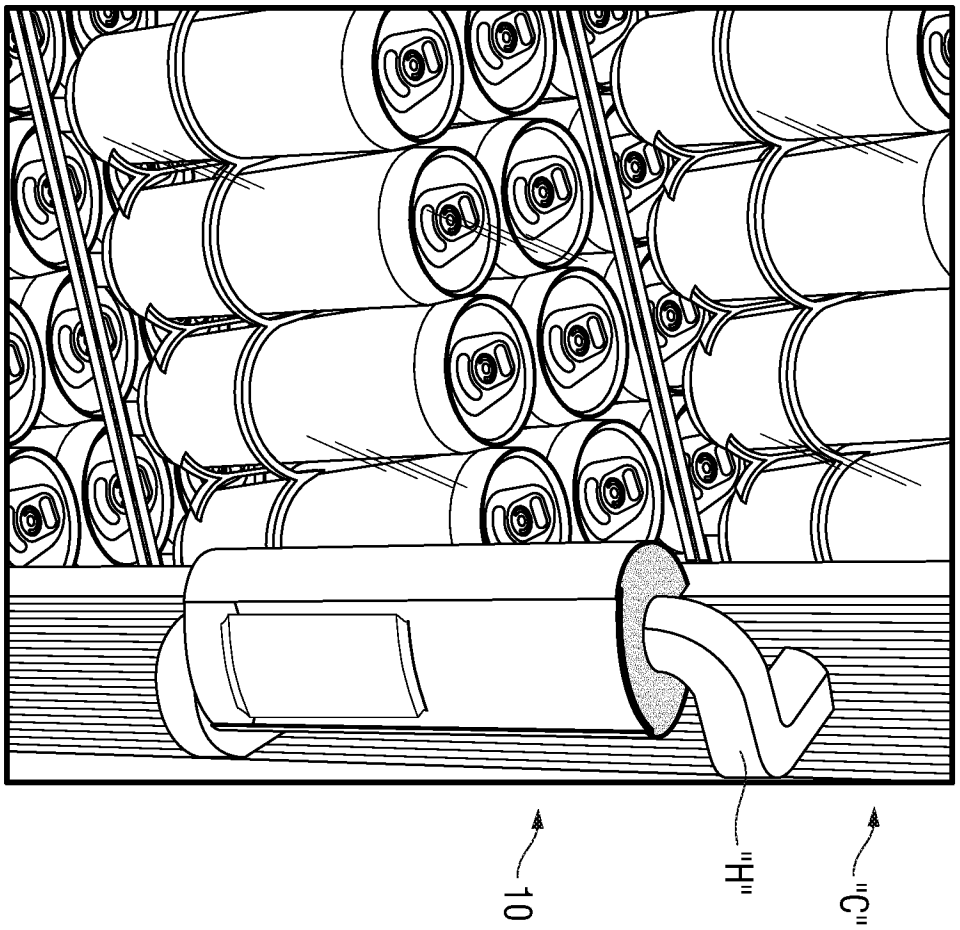
FIG. 3 is a perspective view of the door handle display member of FIGS. 1 and 2 shown in use on a door handle.
Figure 4:
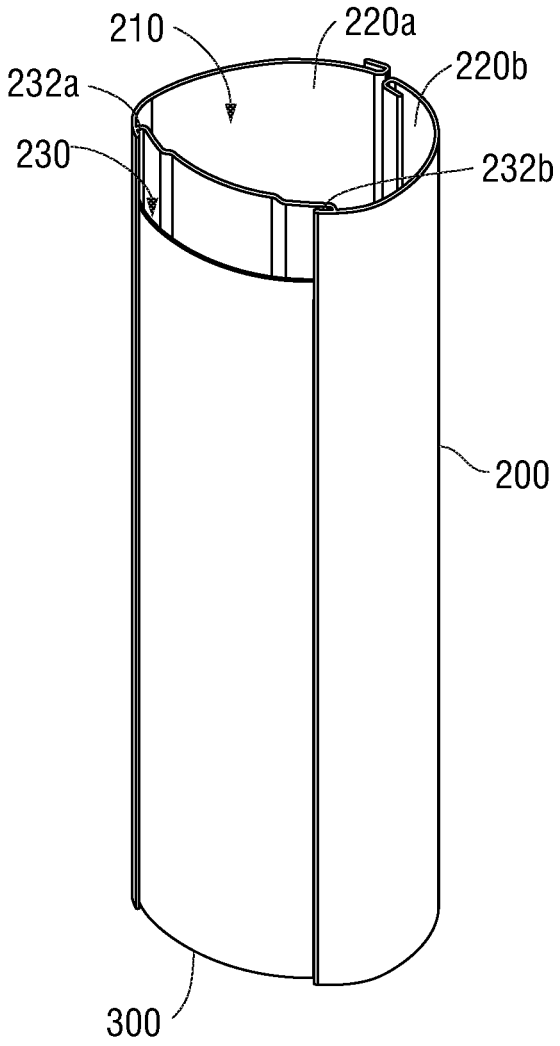
FIG. 4 is a perspective view of the door handle display member of FIGS. 1-3 with the foam portion omitted.
Figure 6:
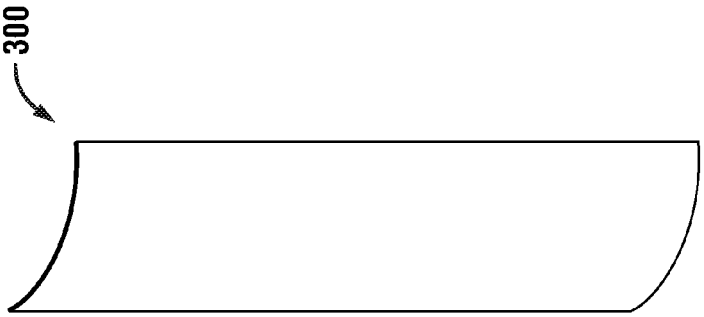
FIG. 6 is a perspective view of the graphic panel of the door handle display member of FIG. 4.
Figure 5:
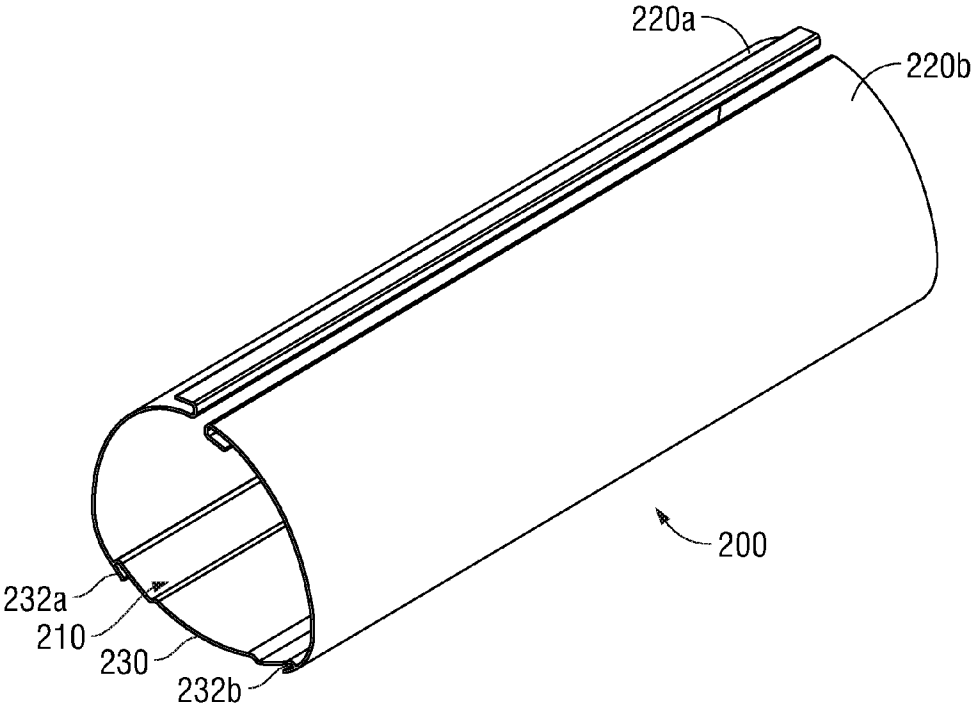
FIG. 5 is a perspective view of the housing of the door handle display member of FIG. 4.

Inner portion 100 is configured for engagement with a door handle "H" of a refrigerated case "C," for example (see FIG. 3). Inner portion 100 may be made of foam or any other material suitable to releasably engage a door handle "H." Inner portion 100 is generally cylindrical in shape, and defines a hollow channel 110 extending therethrough between an upper-most portion and a lower-most portion. While channel 110 is shown having a generally circular cross-section, other cross-sectional shapes of channel 110 are envisioned.

Additionally, a wall 120 of the inner portion 100 includes a gap 130 extending therethrough, which extends the entire length "L" of inner portion 100 and extends radially into engagement with channel 110, such that a transverse cross-section of inner portion 100 is C-shaped. It is contemplated that the gap 130 may extend only partially along the length "L" of the inner portion 100. Channel 110 is configured to allow the door handle "H" to be at least partially radially surrounded by the walls 120 of inner portion 100. As inner portion 100 and housing 200 are adjustable throughout a plurality of sizes, this configuration allows member 10 to accommodate different sized door handles "H". Gap 130 is configured to facilitate or allow the walls 120 to wrap around the door handle "H" such that the door handle "H" can enter or engage the channel 110 (or the wall 120 directly adjacent channel 110). It is envisioned that edges 122, 124 of the walls 120 adjacent the gap 130 are configured to releasably engage each other, e.g., with a hook-and-loop-type fastener, such as Velcro® (e.g., low profile Velcro®).

Housing 200 is configured to engage, e.g., frictionally engage, inner portion 100 by way of a housing channel 210 (FIG. 4) extending therethrough. That is, housing 200 is configured to wrap around or at least partially encircle inner portion 100. Housing 200 may be made from any suitable material, e.g., plastic, and may be formed in any suitable way, e.g., extruded. It is envisioned that housing 200 frictionally engages inner portion 100 in a secure manner, which helps inhibit unintentional separation or relative movement therebetween.

Housing 200 includes a generally C-shaped cross-section. Legs 220*a*, 220*b* (FIG. 4) of housing 200 are being biased toward each other, and separable from one another to accept and/or at least partially surround inner portion 100 therebetween or therewithin. With continued reference to FIG. 4, housing 200 also includes a slot 230 defined by two c-shaped channels 232*a*, 232*b* for releasably accepting graphic panel 300 therein. For example, graphic panel 300 is slidingly engageable with slot 230 of housing 200. It is envisioned that channels 232*a*, 232*b* are open on a first end (e.g. the top) and closed on a second end (e.g., the bottom). A closed bottom end helps ensure graphic panel 300 does not slide down out of engagement with housing 200. Graphic panel 300 may be the same length "L" as inner portion 100 and/or housing 200, or graphic panel 300 may be longer or shorter than either inner portion 100 and/or housing 200.

As can be appreciated, the graphic panel 300, which may be made from plastic or another suitable material, can be tailored to any specific or desirable need. For example, graphic panel 300 can display advertising information, product information, price information, etc., and is easily replaceable to depict a different product, for example, by sliding graphic panel 300 upward (or downward) with respect to housing 200. The graphic panel 300 on a refrigerator door handle "H," for example, provides an additional area of advertisement for a retailer, which may lead to greater product sales. Moreover, the disclosed door handle display members 10, e.g., those including a foam inner portion 100, provide an additional benefit of providing an insulating and padded layer between the cold, hard door handle "H" and a customer's hand.

Figure 7:
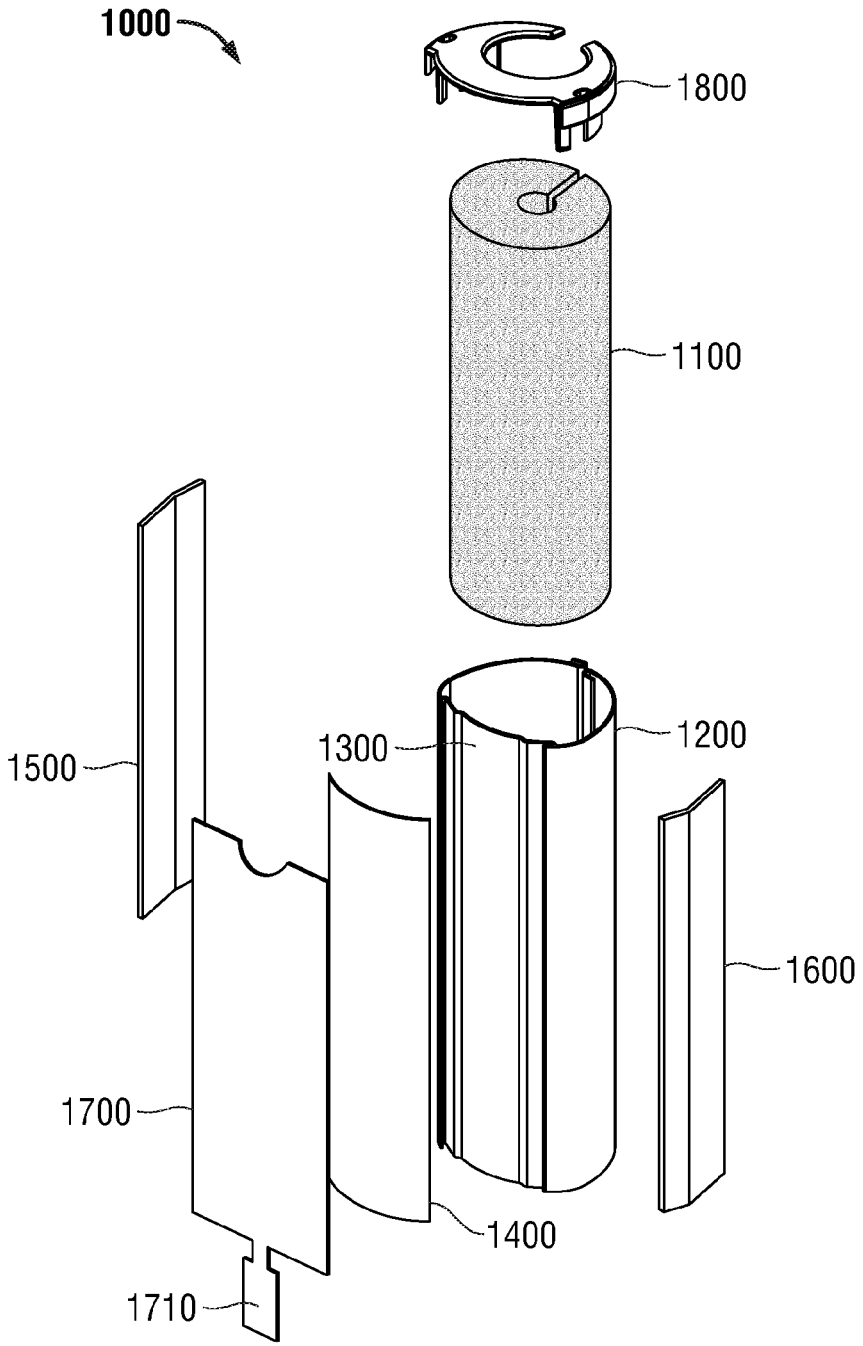
FIG. 7 is a perspective, assembly view of a different embodiment of a door handle display member according to the present disclosure.
Figure 8:
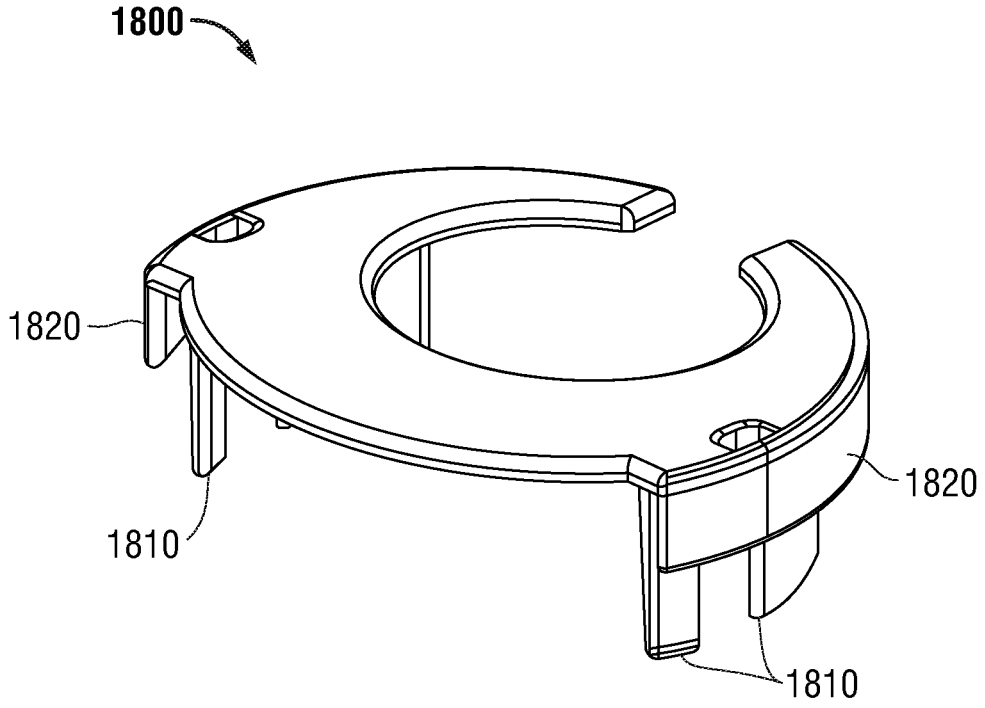
FIG. 8 is a perspective view of a cap of the door handle display member of FIG. 7.

With reference to the accompanying figures, a second embodiment of a door handle display member 1000 is illustrated in FIGS. 7-8. Door handle display member 1000 includes an inner portion 1100, a housing 1200, a first information display portion 1300, a second information display portion (e.g., a graphic panel) 1400, a first lateral display portion 1500, a second lateral display portion 1600, a cover panel 1700, and a cap 1800.

Several features of door handle display member 1000 are the same or similar to door handle display member 10, described above, such as inner portion 1100 which corresponds to inner portion 100, housing 1200 which corresponds to housing 200, and second information display portion 1400 which corresponds to graphics panel 300.

With particular regard to FIG. 7, it is envisioned that first information display portion 1300 is adhered to housing 1200, such that first information display portion 1300 is permanent or non-interchangeable. Any suitable adhesive(s) may be used to adhere first information display portion 1300 to housing 1200. Second information display panel 1400 fits over (i.e., radially outward of first information display portion 1300). It is envisioned that second information display panel 1400 engages housing 1200 in a similar fashion to the way graphic panel 300 of member 10 engages housing 200, as discussed above. Similar to graphic panel 300, second information display portion 1400 is interchangeable or removable. The ability to mix and match graphic information provides flexibility in displaying product information.

It is envisioned that first lateral display portion 1500 and second lateral display portion 1600 are adhered to respective lateral sides of housing 1200, such that first lateral display portion 1500 and second lateral display portion 1600 are permanent or non-interchangeable. It is further envisioned that first lateral display portion 1500 and second lateral display portion 1600 mechanically engage housing 1200 (e.g., snap or slide into place) in such a way that first lateral display portion 1500 and second lateral display portion 1600 are interchangeable. As can be appreciated, first lateral display portion 1500 and second lateral display portion 1600 allow customers to view product advertisements when viewed from the sides of a refrigerated case, for example.

With continued reference to FIG. 7, door handle display member 1000 includes cover panel 1700. Cover panel 1700 is configured to selectively engage housing 1200 (e.g. slide into channels of housing 1200 similar to the engagement between graphic panel 300 and housing 200 of door handle display member 10). It is envisioned that cover panel 1700 is transparent or translucent, and that cover panel 1700 is made from a suitable material, such as plastic. Further, in the illustrated embodiment, cover panel 1700 includes a tab 1710 extending from its lower edge. Tab 1710 is configured to fold radially inwardly and engage (e.g., adhere to) housing 1200 and/or inner portion 1100 to help prevent second information display panel 1400 from falling out of engagement with housing 1200.

With reference to FIG. 8, cap 1800 is shown. Cap 1800 is configured to mechanically engage a top end of inner portion 1100 and/or housing 1200. It is envisioned that cap 1800 benefits the aesthetic presentation of member 1000. Further, it is envisioned that cap 1800 helps maintain the positioning of any combination of second information display panel 1400, cover panel 1700, first lateral display panel 1500 and second lateral display panel 1600 (e.g., when first lateral display panel 1500 and second lateral display panel 1600 are interchangeable) with respect to inner portion 1100 and/or housing 1200. Moreover, it is envisioned that a first set of legs 1810 is configured to slide between inner portion 1100 and housing 1200, and that a second set of legs 1820 (which is disposed radially outward of first set of legs 1810) is configured to be positioned radially outward of cover panel 1700 and/or first lateral display panel 1500 and second lateral display panel 1600.

Additionally any combinations of door handle display member 10 and door handle display member 1000 are also contemplated by the present disclosure.

The present disclosure also includes methods of displaying product information using door handle display member 10, 1000. Additionally, the present disclosure includes installing door handle display member 10, 1000 on a door handle "H."

While embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A door handle display member, comprising:

an inner portion configured to releasably engage a door handle, such that the inner portion at least partially surrounds the door handle;

a housing configured to engage the inner portion, such that the housing at least partially surrounds the inner portion;

at least one information display panel adhered to the housing;

a graphic panel configured to releasably engage the housing, the graphic panel being disposed radially outward of the at least one information display panel; and a cover panel configured to releasably engage the housing, the cover panel being disposed radially outward of the graphic panel, the cover panel including a tab configured to engage at least one of the inner portion and the housing to help prevent the graphic panel from falling out of engagement with the housing.

2. The door handle display member according to claim 1, wherein the housing includes a slot configured to slidingly engage the graphic panel.

3. The door handle display member according to claim 2, wherein the graphic panel is configured to slidingly engage the slot of the housing.

4. The door handle display member according to claim 1, wherein the inner portion is made out of foam.

5. The door handle display member according to claim 1, wherein the inner portion includes a C-shaped cross-section.

6. The door handle display member according to claim 1, wherein the at least one information display panel includes a first lateral information display panel and a second lateral information display panel.

7. The door handle display member according to claim 6, further comprising a third information display panel disposed between the first lateral information display panel and the second lateral information display panel.

8. A door handle display member, comprising:

an inner portion configured to releasably engage a door handle, such that the inner portion at least partially surrounds the door handle;

a housing configured to engage the inner portion, such that the housing at least partially surrounds the inner portion;

a graphic panel configured to releasably engage the housing; and a cover panel configured to releasably engage the housing, the cover panel being disposed radially outward of the graphic panel, the cover panel including a tab configured to engage at least one of the inner portion and the housing to maintain engagement between the graphic panel and the housing.

9. The door handle display member according to claim 8, wherein the graphic panel is disposed radially outward of the housing.

* * * * *